United States Patent [19]

Sokaris

[11] 4,159,618

[45] Jul. 3, 1979

[54] COMPOSITE YARN

[75] Inventor: Jerry G. Sokaris, Troy, N.Y.

[73] Assignee: Albany International Corp., Albany, N.Y.

[21] Appl. No.: 885,756

[22] Filed: Mar. 13, 1978

[51] Int. Cl.[2] ..... D02G 3/18; D02G 3/36

[52] U.S. Cl. ..... 57/251; 57/249; 57/297; 57/904; 428/364

[58] Field of Search ..... 57/140 G, 140 C, 149, 57/153, 162, 164; 428/364, 375, 380, 383, 392, 395

[56] References Cited

U.S. PATENT DOCUMENTS

| | | | |
|---|---|---|---|
| 2,369,876 | 2/1945 | Warren | 57/140 G |
| 2,903,779 | 9/1959 | Owens | 57/140 G |
| 3,371,476 | 3/1968 | Costello et al. | 57/140 G X |
| 3,413,186 | 11/1968 | Marzocchi | 57/153 X |
| 3,843,587 | 10/1974 | Keating et al. | 428/383 X |
| 3,881,977 | 5/1975 | Dauksys | 428/375 X |
| 4,056,651 | 11/1977 | Scola | 428/392 X |

*Primary Examiner*—Donald Watkins
*Attorney, Agent, or Firm*—Kane, Dalsimer, Kane, Sullivan and Kurucz

[57] ABSTRACT

The disclosure is of a high temperature resistant, composite yarn useful in the manufacture of woven and knitted fabrics for high temperature applications. The yarn of the invention comprises a core of a twisted, multi-filament or spun yarn and an outer coating or sheath of a high temperature resistant, synthetic, polymeric resin. The multi-filaments or staple fibers of the core are selected from high temperature resistant, synthetic materials. The outer coating comprises a plurality of coating layers intimately bonded to each other and to the twisted core so as to give the composite yarn of the invention an outward appearance and other characteristics of a monofilament. The composite yarn of the invention combines the properties of a monofilament and a multi-filament or staple yarn and is useful in weaving high temperature resistant fabrics.

10 Claims, 3 Drawing Figures

COMPOSITE YARN

BACKGROUND OF THE INVENTION

1. Field of the Invention

This invention relates to high temperature resistant yarns and more particularly relates to a composite yarn including a twisted multi-filament or spun core coated successively with a plurality of resin layers to produce a pseudo-monofilament.

2. Brief Description of the Prior Art

The prior art is replete with descriptions of coated yarns. Representative of the prior art are the disclosures of U.S. Pat. Nos. 2,735,258; 3,029,590; and 3,739,567. See also the disclosures of U.S. Pat. Nos. 2,799,598; 3,366,001; and 4,015,038. The composite yarns of the present invention are high temperature resistant pseudo-monofilaments which advantageously replace monofilaments of metal or polyesters in high temperature resistant fabrics. As replacement yarns, the composite yarns of the invention exhibit better flex fatigue properties than metal wires and higher temperature resistance than polyester mono-filaments.

SUMMARY OF THE INVENTION

The invention comprises a high temperature resistant, composite yarn, which comprises;

a core of a twisted, multi or spun filament yarn, said filament being of a high temperature resistant, synthetic material; and an outer coating of a high temperature resistant, synthetic, polymeric resin, said coating comprising a plurality of coating layers, the inner layers being intimately bonded to the core and filling the helix of the twist in the core yarn and the outer layers being bonded to the inner layers and encapsulating the inner layers and core so as to give the composite yarn the appearance and characteristics of a monofilament.

The composite yarns of the invention are useful to manufacture woven and knitted fabrics for high temperature applications, exhibiting composite properties of both mono-filaments and multi-filament or spun yarns.

The invention also comprises a method of preparing the composite yarns of the invention, said method comprising providing a core of a twisted, multi or spin filament yarn, said multi-filament or spun yarns being of a high temperature resistant, synthetic material; and sequentially covering said yarn with a plurality of coatings of a high temperature resistant, synthetic, polymeric resin until there is obtained a composite yarn having the appearance and characteristics of a monofilament.

The term "high temperature resistant" as used herein means the material, resin or yarn will not significantly degrade after exposure to temperatures of at least 400° F. to 500° F. for extended periods of time.

DETAILED DESCRIPTION OF THE PREFERRED EMBODIMENTS OF THE INVENTION

Figure 2:
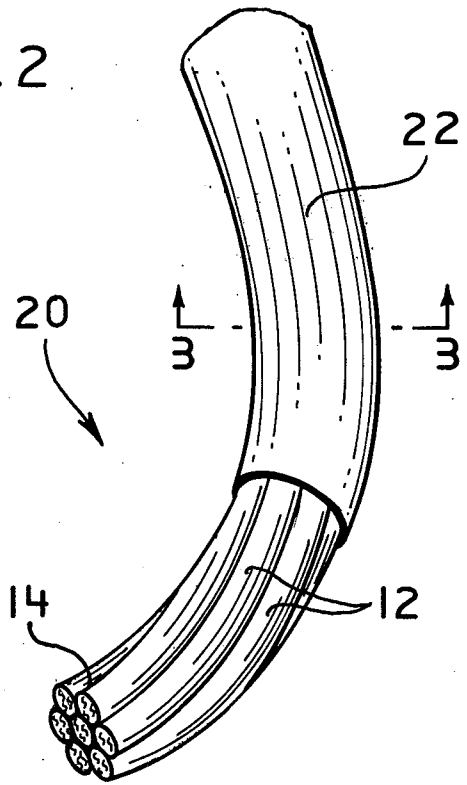
FIG. 2 is a view in perspective of an embodiment composite yarn of the invention, partially cut away.

The method of the invention is carried out by first providing for the composite yarns of the invention a core material which comprises a twisted, multi-filament yarn or spun yarn of any high temperature resistant, synthetic material. Representative of such yarns are multi-filament yarns of glass, carbon, aramid, polybenzimidazole, polyoxyadiazole, fibers, mixtures thereof and the like. Spun yarns from staple fibers include fibers of aramid, ceramic, novaloid and blends thereof spun into yarns. The multi-filament or spun yarns are twisted to render them dimensionally stable and in a cylindrical shape. Although the number of twists is not critical, it is generally advantageous that the multi-filament or spun yarns bear 2 to 15 twists per inch. Generally, the softer twists in the multi-filament yarns are preferred, providing a more cylindrical shape with smaller "valleys" in the helix formed by the twisting.

The twisted multi-filament or spun yarn is then coated in successive or sequential steps with a plurality of coatings of a high temperature resistant, synthetic, polymeric resin. Coating is effected so that the inner layers, of a plurality of layers, are intimately bonded to the core yarn and close the helix of the twist in the core yarn. Successively applied outer layers are bonded to the preceeding inner layers of coating and completely encapsulate the inner layers and core yarn so as to give the composite yarn the physical appearance of a monofilament. A plurality of relatively thin coating layers is advantageous in comparison to a single, thicker coating filling in the helix of the core yarn, providing for greater flexability in the product, i.e.; on the order of flexibility found in mono-filaments. Any known high temperature resistant, synthetic, polymeric resin coating may be employed in the method of the invention to provide the composite yarns of the invention. Representative of such resins are polysulfones, organopolysilicones, polyphenylene sulfide, polyepoxides, polyesters, polyester-imide, polyamide-imide, polyimides, polyquinozalines, mixtures thereof and like high temperature resistant resin.

The invention is not limited to the use of a single resin, but includes also a combination of resins as separate coating layers or as mixtures.

In a preferred embodiment method of the invention, the high temperature resistant polymeric resin coatings may be applied to the core yarns by repeatedly passing the core yarns through a conventional wire enamelling machine, using gradually increasing die sizes until the desired mono-filament character is obtained. This procedure provides excellent bonding of the coating layers while maintaining a flexible yarn. Representative of the wire enamelling apparatus which may be used is the General Electric vertical enamelling tower used in conjunction with doghouse dies. Horizontal type machines with roller dies or felt wipes may also be used. Preferably, after each coating layer is applied to the core yarn, drying and/or partial curing of the applied layer is effected before successive layers are applied.

Figure 3:
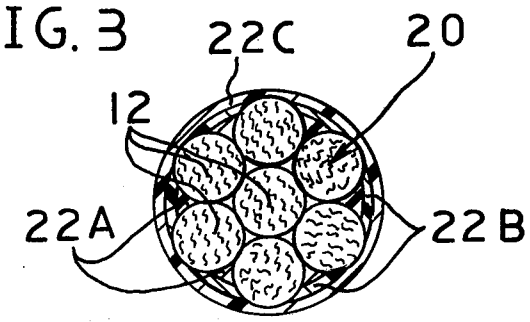
FIG. 3 is a cross-sectional side elevation along lines 3—3 of FIG. 2.
Figure 1:
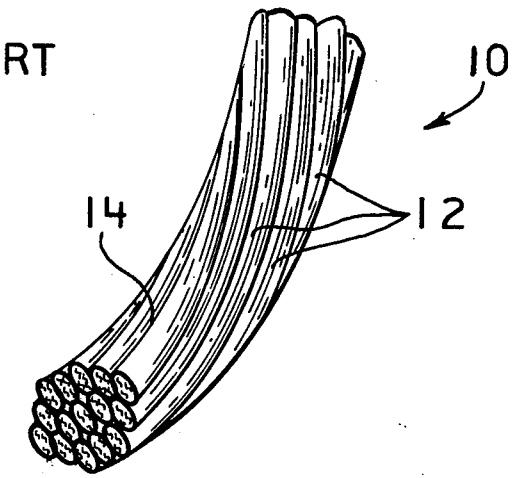
FIG. 1 PRIOR ART
FIG. 1 is a view in perspective of a portion of twisted yarn as is known in the prior art.

Referring now to FIG. 1, one can see a view in perspective of a portion of a twisted multi-filament yarn 10 which comprises filaments 12 twisted to provide a cylindrical cross-section with valleys 14 between the twisted filaments. This twisted multi-filament yarn 10 is coated as described above with a plurality of resin layers to provide the mono-filament appearance of the composite yarn 20 shown in FIG. 2. As seen in FIG. 2, a view in perspective of a preferred embodiment composite yarn of the invention partially cut-away, the twisted multi-filaments 12 are encapsulated and covered by a coating 22 of a high temperature resistant, synthetic, polymeric resin. As shown more specifically in FIG. 3, a cross-sectional view along lines 3—3 of FIG. 2 one can see that the valleys 14 between the outer filaments 12 have been filled in by the synthetic polymeric resin *22a*. In successive coatings, the twisted multi-filament 10 is successively coated with layers of polymeric resin *22b* and *22c*, the latter *22c* layer completely encapsulating the inner layers *22a* and *22b* and the core of multi-filament yarn 10. In this manner, the physical appearance of a monofilament is obtained. Replacing the multifilament core with a twisted spun yarn in the above-described procedure, yarns of the invention are also obtained.

The following examples describe the manner and process of making and using the invention and set forth the best mode contemplated by the inventor for carrying out the invention. The test procedures used to characterize the pseudo-monofilaments of the invention are as follows:

BREAKING TENACITY: The average tensile strength in pounds as measured by ASTM Method D-638-58T, converted to grams and divided by the average yarn weight per unit length in deniers (grams/9000 meters) and expressed as GPD.

MIT FLEX FATIGUE: A 500 gm. weight with a #2 spring was used.

EXAMPLE 1

A 200 denier, 3-ply twisted multi-filament aramid yarn obtained from a polymer of m-phenylenediamine and isophthaloyl chloride (Nomex, E.I. DuPont de Nemours and Co., Wilmington, Del.) is sequentially coated with a polamide-imide resin (XWE-960, Schenectedy Chemical Co.) by a plurality of passes through a General Electric, 15 foot vertical type wire enamelling machine.

During each passage through the enamelling machine, the temperature at the lower zone of the vertical oven is maintained at 400° F. and in the upper zone at 700° F. Passage of the yarn through the machine is at a speed of 12 feet per minute on each pass. Coating is accomplished with seven passes through the enamelling machine, employing doghouse dies using a whole size sequence of 0.013 inch, 0.014 inch, 0.014 inch, 0.015 inch 0.015 inch, 0.016 inch, and 0.016 inch. After each coating pass the coated product is dried and the coating cured prior to the next pass through the enamelling machine. The original yarn provided had a diameter of 0.008 inches. The finished product, having the appearance of a monofilament, has a diameter of 0.014 inches. The calculated add on weight of the polymeric resin (polyamide-imide) is 55 percent. Representative portions of the composite yarn prepared according to this example are exposed for various periods of time to moist and dry heat. The exposed portions are then tested for their breaking tenacity. The results are shown in Table 1., below.

Table 1

| No. Days Exposure | Breaking Tenacity (qpd) |
|---|---|
| Dry Heat at 500° F. | |
| 0 | 3.8 |
| 1 | 3.3 |
| 3 | 2.6 |
| 7 | 1.9 |
| 10 | 1.9 |
| 15 | 2.1 |
| 21 | 1.9 |
| Moist Heat at 250° F. - 15 psi | |
| 0 | 3.8 |
| 1 | 3.6 |
| 3 | 3.6 |
| 7 | 3.5 |
| 10 | 3.4 |
| 15 | 3.4 |
| 21 | 3.3 |

The pseudo-monofilaments are flexible and may be woven into fabrics.

EXAMPLE 2

A 200 denier, 3-ply twisted aramid multi-filament (Kevlar; E. I. DuPont, Supra) yarn is provided having an outer diameter of 0.009 inches. The provided yarn is coated with a polyimide resin (Pyre- M.L., DuPont, supra.) on a 9 foot, General Electric vertical wire enamelling machine, by twelve passes employing doghouse dies using a hole size sequence of 0.010 inches, 0.010 inches, 0.011 inches, 0.012 inches, 0.013 inches, 0.014 inches, 0.014 inches, 0.015 inches, 0.015 inches, 0.016 inches, 0.016 inches, and 0.016 inches. After each coating pass the coated product is dried and the coating cured prior to the next pass. The temperature profile of the vertical oven employed was 250° F. at the bottom, 450° F. in the center of the oven and 840° F. at the top of the oven. The yarn was passed through the enamelling machine at a speed of 23 feet per minute. The finished product had a diameter of 0.014 inches with a calculated add on weight of resin of 70 percent. The final product had the appearance of a mono-filament. Representative portions of the product yarn are exposed to dry or moist heat for various periods of time. The exposed portions are then tested for breaking tenacity. The results are shown in Table 2, below. A portion tested for Flex (MIT flex) showed a result of 913 cycles.

TABLE 2

| No. of Days Exposure | Breaking Tenacity (qpd) |
|---|---|
| Dry Heat at 500° F. | |
| 0 | 8.3 |
| 1 | 5.5 |
| 3 | 5.6 |
| 8 | 4.5 |
| 12 | 2.2 |
| 16 | 1.1 |
| 22 | 1.1 |
| Moist Heat at 250° F. - 15 psi | |
| 0 | 8.3 |
| 1 | 6.4 |
| 3 | 7.8 |
| 8 | 5.3 |
| 12 | 4.9 |
| 16 | 1.0 |
| 22 | 1.2 |

The pseudo-monofilaments may be woven into fabrics.

EXAMPLE 3

A 200 denier, 3-ply aramid multifilament (Kevlar; E. I. DuPont, Supra) twisted yarn is provided having an outer diameter of 0.009 inches. The provided yarn is coated with a polyamide-imide resin on a 10 feet horizontal wire enamelling machine using eleven passes employing roller dies using a roller die sequence of 2/6-½, 2/7, 3/7-½, 2/8 and 2/8-½. After each coating pass the composite product is dried and the coating cured. The temperature profile of the horizontal oven employed is 300° F., 475° F. and 650° F. The yarn is passed through the enamelling machine at a speed of 35 feet per minute. The finished product has a diameter of 0.015 inches with a calculated add-on weight of resin of 60 percent. The final product has the appearance of a mono-filament. Representative portions are exposed to moist or dry heat for varying periods of time. The exposed portions are then tested for breaking tenacity. The test results are shown in Table 3, below.

TABLE 3

| No. of Days Exposure | Breaking Tenacity (qpd) |
|---|---|
| Dry Heat at 500° F. | |
| 0 | 8.3 |
| 1 | 5.5 |
| 3 | 4.8 |
| 8 | 3.9 |
| 12 | 1.6 |
| 16 | 0.9 |
| 22 | 0.8 |
| Moist at 250° F. - 15 psi | |
| 0 | 8.3 |
| 1 | 6.8 |
| 3 | 6.8 |
| 8 | 4.9 |
| 12 | 4.2 |
| 16 | 2.2 |
| 22 | 0.9 |

The pseudo-monofilament produced may be woven into a fabric on a conventional weaving loom. When tested for Flex (MIT flex) the product monofilament showed a test result of 384 cycles in comparison to a Bronze wire (0.016" in diameter) which showed 14 cycles.

EXAMPLE 4

A 25/1 staple aramid yarn (Kevlar, supra) spun on the cotton system is provided having an outer diameter of 0.005 inches. The provided yarn is coated with a polyimide resin (DuPont's RC-5057) using five passes on a horizontal enamelling machine and employing felt wipe type of applicators. After each coating pass the coated product is dried and the coating cured. The finished product has a diameter of 0.009 inches. The final product has a monofilament type appearance and is flexible enough to be woven.

Similarly, repeating the above procedure but replacing the polyimide as used therein with a polysulfone or an organopolysilicone or a polyphenylene sulfide or a polyepoxide or a polyester or a polyester-imide or a polyquinoxaline, a composite yarn of the invention is obtained.

The pseudo-monofilament of Examples 1–4 exhibit better flex fatigue resistance than comparable size metal wires and improved heat resistance at high temperatures over, for example, polyester monofilaments.

What is claimed:

1. A high temperature resistant, composite yarn having the appearance and physical characteristics of a monofilament yarn, which comprises;

a core of a twisted, multi or spun filament yarn, said filament being of a high temperature resistant, synthetic material; and an outer coating of a high temperature resistant, synthetic, polymeric resin, said coating comprising a plurality of coating layers, including a plurality of inner layers intimately bonded to the core and filling the helix of the twist in the core yarn only and outer layers being bonded to the inner layers and encapsulating the inner layers and the core so as to give the composite yarn the appearance and characteristics of a mono-filament.

2. The composite yarn of claim 1 wherein the filaments are multi-filaments selected from the group consisting of a glass, aramid, carbon, graphite, polybenzimidazole, polyoxodiazole and mixtures thereof.

3. The composite yarn of claim 1 wherein the core yarn is a spun yarn of staple fibers selected from the group consisting of aramid, ceramic, novaloid and mixtures thereof.

4. The composite yarn of claim 2 wherein the filament selected is an aramid.

5. The composite yarn of claim 2 wherein said filament selected is a novaloid.

6. The composite yarn of claim 3 wherein the fiber selected is ceramic.

7. The composite yarn of claim 1 wherein the resin is selected from the group consisting of polysulfones, organopolysilicones, polyphenylene sulfide, polypoxides, polyesters, polyester-imide, polyamide-imide, polyimides, polyquinoxalines and mixtures thereof.

8. The composite yarn of claim 7 wherein the resin selected is a polyamide-imide.

9. The composite yarn of claim 7 wherein the resin selected is a polyimide.

10. A method of preparing a high temperature resistant composite yarn having the appearance and physical characteristics of a monofilament yarn, which comprises;

providing a core of a twisted, multi- or spun filament yarn, said multi-filament or spun yarn being of a high-temperature resistant, synthetic material;

sequentially layering a plurality of relatively thin coating layers of a high temperature resistant, synthetic, polymeric resin in the helix of the core yarn until said helix is filled; and covering the helix filled yarn with a coating of a high temperature resistant, synthetic, polymeric resin whereby there is obtained a composite yarn having the appearance and characteristics of a monofilament.

* * * * *